US008400300B2

(12) United States Patent
Oleen

(10) Patent No.: US 8,400,300 B2
(45) Date of Patent: Mar. 19, 2013

(54) DIAPER CHANGING WALLET

(76) Inventor: Victoria A. Oleen, Las Vegas, NV (US)

( * ) Notice: Subject to any disclaimer, the term of this patent is extended or adjusted under 35 U.S.C. 154(b) by 498 days.

(21) Appl. No.: 12/717,215

(22) Filed: Mar. 4, 2010

(65) Prior Publication Data

US 2011/0215009 A1 Sep. 8, 2011

(51) Int. Cl.
*G08B 13/08* (2006.01)

(52) U.S. Cl. ..... 340/545.6; 206/581; 220/521; 340/691.5; 340/693.5; 340/815.4

(58) Field of Classification Search ..... 340/545.6, 340/545.2, 545.3, 568.1, 568.7, 691.1, 691.2, 340/691.5, 815.4, 815.65, 692, 384.3, 384.7, 340/693.5; 206/581; 220/521; 150/112, 150/113

See application file for complete search history.

(56) References Cited

U.S. PATENT DOCUMENTS 4,574,822 A * 3/1986 Helinsky ..... 206/823
4,961,522 A * 10/1990 Weber ..... 224/585
5,638,957 A 6/1997 Brasier
5,926,099 A * 7/1999 Unum ..... 340/686.1
6,168,022 B1 1/2001 Ward et al.
6,412,652 B1 7/2002 Woram et al.
6,540,084 B2 4/2003 Silvers
7,284,790 B1 * 10/2007 Brewer ..... 297/184.13
7,367,449 B2 5/2008 Kaminski et al.
7,942,296 B1 * 5/2011 Johnson ..... 224/578

* cited by examiner

*Primary Examiner* — Thomas Mullen
(74) *Attorney, Agent, or Firm* — Dale J. Ream

(57) ABSTRACT

A wallet includes semi-rigid first and second portions each having an outer side and an inner side, the second portion being hingedly coupled to the first portion whereby the second portion is movable relative to the first portion to define open and closed configurations. The first portion inner side includes a pocket. A foldable changing pad is operatively coupled to at least one of the first portion and the second portion. The wallet includes a speaker and a sensor for determining when the first and second portions are at the open configuration. A processor is data communication with the speaker and the sensor. Programming causes the processor to automatically actuate the speaker an amount of time after the sensor determines that the first and second portions are at the open configuration.

16 Claims, 4 Drawing Sheets

DIAPER CHANGING WALLET

BACKGROUND OF THE INVENTION

This invention relates generally to infant accessory items and, more particularly to a diaper changing wallet having structures that enable an array of products useful for changing an infant's diaper to be removably secured as well as entertaining an infant during a diaper changing procedure.

Changing the diaper of an infant, especially when away from home, may be challenging in that a flat, clean environment, a host of cleaning supplies, and a fresh diaper must all be brought together for use. The myriad of needed items, such as cleaning wipes, creams, powder, medicine, diaper, and a changing pad are traditionally carried in a baby bag which may be overly bulky when traveling away from home.

Various devices have been proposed in the art for holding diaper changing accessories in a manner more convenient and portable than a traditional baby bag. Although assumably effective for their intended purposes, the existing devices do not provide a stylish compact wallet capable of being carried by a man or woman apart from a baby bag and which also includes audible and visual attractions to maintain the attention of a baby during a diaper changing event.

Therefore, it would be desirable to have a diaper changing wallet that overcomes all of the disadvantages of the prior devices and patent proposals.

SUMMARY OF THE INVENTION

A wallet according to the present invention includes semi-rigid first and second portions each having an outer side and an inner side, the second portion being hingedly coupled to the first portion whereby the second portion is movable relative to the first portion to define open and closed configurations. The first portion inner side includes a pocket. A foldable changing pad is operatively coupled to at least one of the first portion and the second portion. The changing pad may fold out either from inside the wallet structure or from an outside pocket. The wallet includes a speaker and a sensor for determining when the first and second portions are at the open configuration. A processor is data communication with the speaker and the sensor. Programming causes the processor to automatically actuate the speaker an amount of time after the sensor determines that the first and second portions are at the open configuration. The outside pocket may also include a plurality of slots for holding credit cards or the like.

Therefore, a general object of this invention is to provide a wallet that in which one or more diapers and wipes may be positioned in an opposing pocket and compartment.

Another object of this invention is to provide a wallet, as aforesaid, a foldable changing pad removably situated so as to isolate the pocket of diapers from the wipes.

Still another object of this invention is to provide a wallet, as aforesaid, that provides audio and video components that may be selected using user input buttons.

Yet another object of this invention is to provide a wallet, as aforesaid, that includes sensors in communication with a processor for activating and deactivating the audio and visual components.

A further object of this invention is to provide a wallet, as aforesaid, that is easy and stylish to carry and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
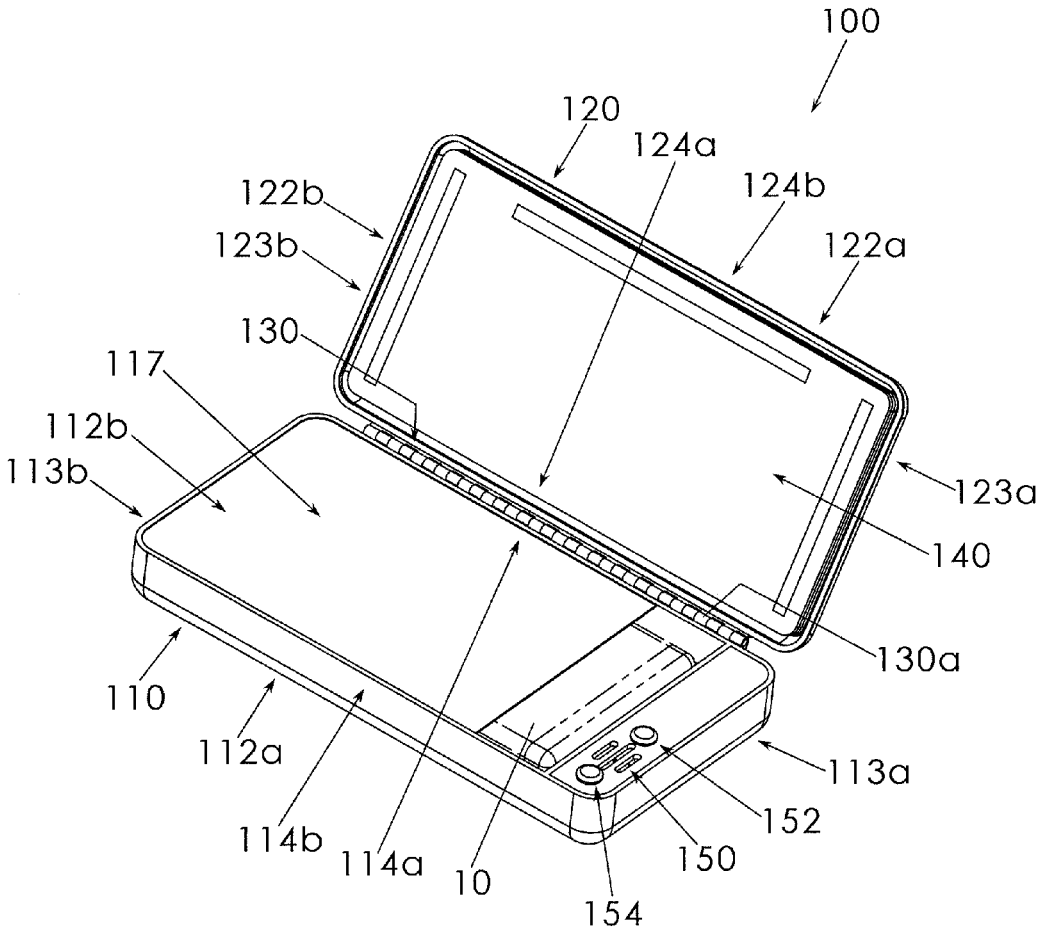
FIG. 1 is a perspective view of a wallet according to a preferred embodiment of the present invention in an open configuration.

Wallets according to the present invention will now be described in detail with reference to FIGS. 1 through 4 of the accompanying drawings. More particularly, a wallet 100 for carrying baby supplies according to one embodiment includes semi-rigid first and second portions 110, 120.

As shown in FIGS. 1 through 4, the first portion 110 has an outer side 112*a* and an inner side 112*b*, upper and lower ends 113*a*, 113*b*, and opposed sides 114*a*, 114*b*. The second portion 120 has an outer side 122*a* and an inner side 122*b*, upper and lower ends 123*a*, 123*b*, and opposed sides 124*a*, 124*b*. The first and second portions 110, 120 are hingedly coupled together (e.g., at sides 114*a*, 124*a* by hinge 130) such that the second portion 120 is movable relative to the first portion 110 to define open and closed configurations. When at the closed configuration, the first and second portions 110, 120 may enclose an interior space. FIGS. 1 through 4 all show the first and second portions 110, 120 at the open configuration, and those skilled in the art will understand the closed configuration without additional figures. Means for temporarily maintaining the first and second portions 110, 120 at the closed configuration, such as a spring-loaded hinge 130*a*, a latch, a strap, or any other acceptable element, may be included.

Figure 2:
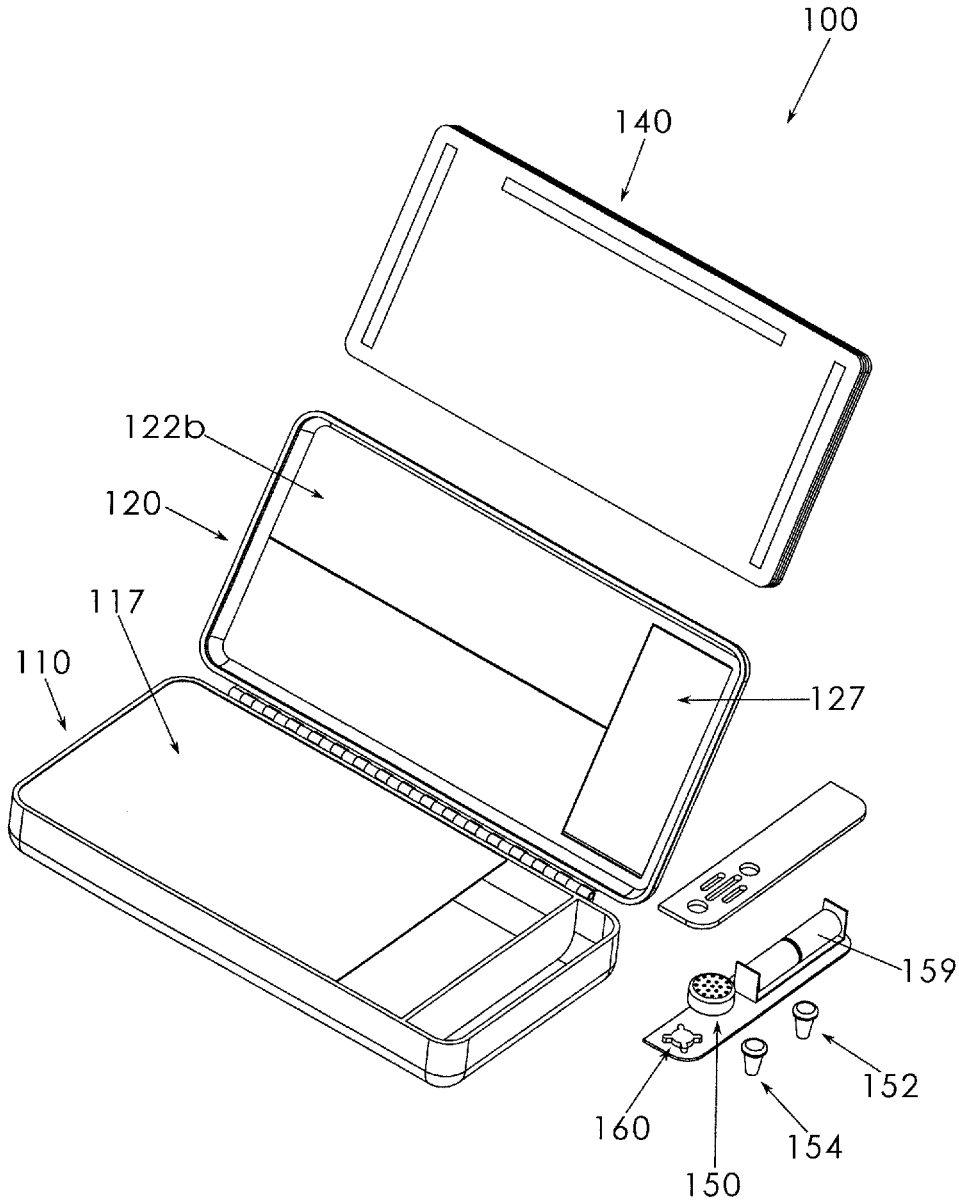
FIG. 2 is an exploded view of the wallet as in FIG. 1.

FIGS. 1 through 4 further show a pocket 117 at the first portion inner side 112*b* for holding a diaper 10. The pocket 117 may extend continuously from the first portion lower end 113*b* to a position closer to the first position upper end 113*a* than to the first portion lower end 113*b*, as shown. Alternately, the pocket 117 may include a band extending between the sides 114*a*, 114*b* (but that does not extend to the first portion lower end 113*b*). Turning now to FIG. 2, a compartment 127 may be at the second portion inner side 122*b* for holding a moist wipe or other item. The compartment 127 may be isolated from the pocket 117, such as by a cover, partition, or other element.

Figure 3:
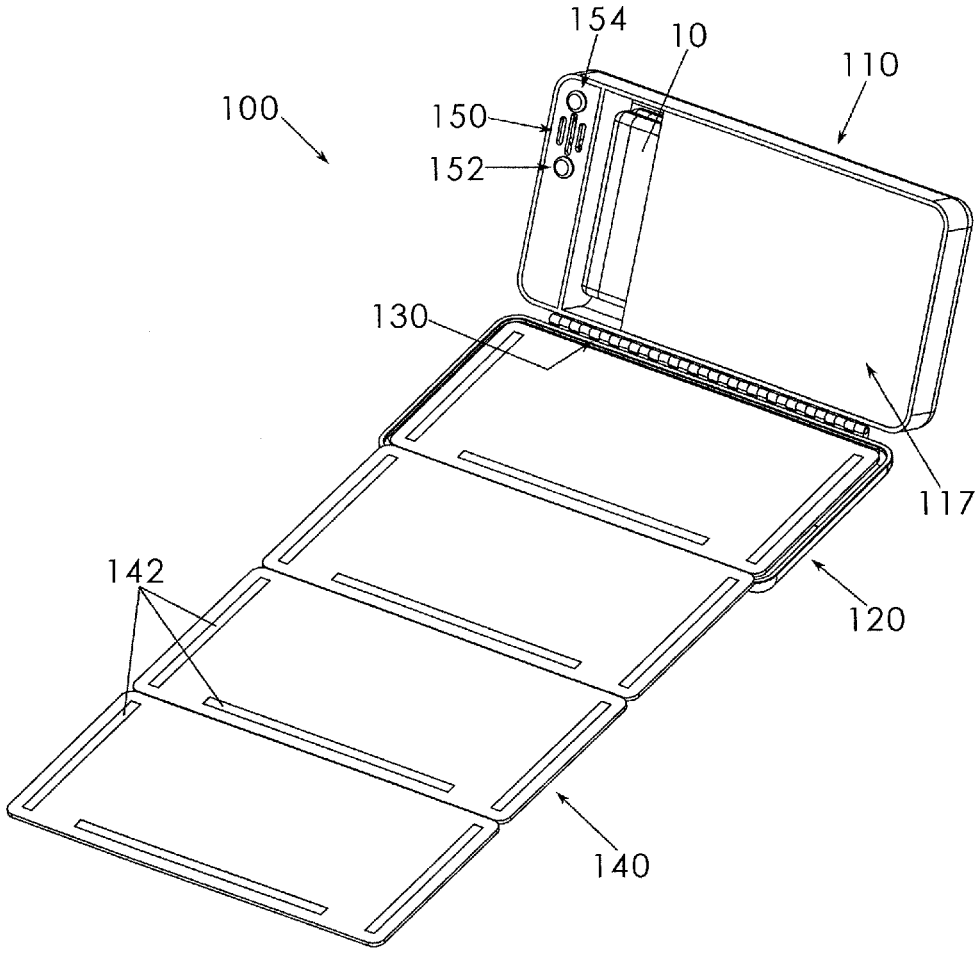
FIG. 3 is a perspective view of the wallet as in FIG. 1 from another angle and with a foldable changing pad in an extended configuration.
Figure 4:
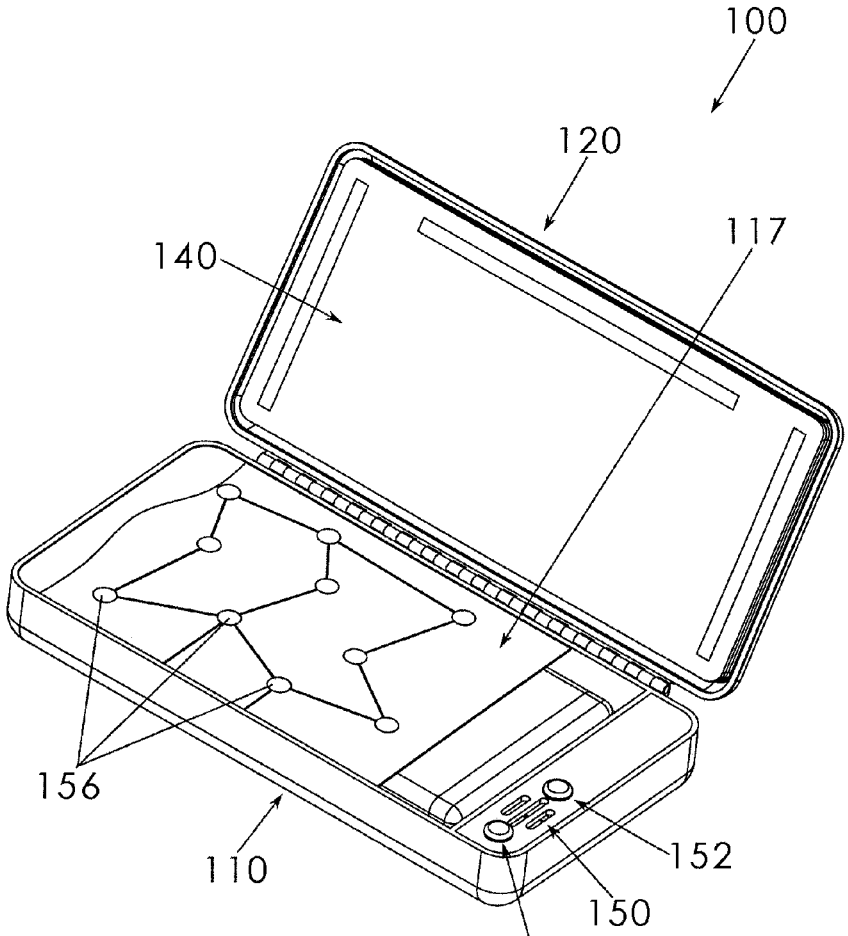
FIG. 4 is another perspective view of the wallet as in FIG. 1 revealing a plurality of lights.

A folding changing pad 140 may be operatively coupled to the first portion 110 and/or the second portion 120. As shown in FIGS. 1, 3, and 4, the changing pad 140 may be located such that it is in the interior space. In such a configuration, the changing pad 140 may isolate the pocket 117 from the compartment 127. The changing pad 140 may include at least one magnet 142 (FIG. 3) for temporarily attaching the changing pad 140 to a ferrous or ferric surface. Alternately, the changing pad 140 may be removably positioned within another pocket (an "auxiliary" pocket) on the exterior of the wallet 100 (not shown). The auxiliary pocket may also include a plurality of slots for holding credit cards and the like such that wallet 100 may be used for both baby supplies and traditional wallet functions.

A speaker 150 and means for determining when the first and second portions 110, 120 are at the open configuration (e.g., push button 152, pressure sensor, light sensor, etc.) may be included, as shown throughout the drawings, and a processor 160 (FIG. 2) may be in data communication with both. A user input 154 (e.g., at least one button, switch, etc.) and/or at least one light 156 (FIG. 4) may also be in data communication with the processor 160, and at least one battery 159 (FIG. 2) or other power supply may power the electrical components. If a plurality of lights 156 are included, the lights 156 may emit different colors such that at least one light 156 outputs a color different from a color of at least one other light 156.

Various programming, including that described herein, for example, may be included. More particularly, programming may be included to cause the processor 160 to automatically actuate the speaker 150 an amount of time after the push button 152 determines that the first and second portions 110, 120 are at the open configuration, and programming may be included to cause the processor 160 to automatically actuate the light(s) 156 an amount of time after the push button 152 determines that the first and second portions 110, 120 are at the open configuration. The speaker 150 and light(s) 156 may be actuated generally simultaneously, or the amount of delay may differ. Programming may select the amount of time for the delay(s) based on data from the user input 154.

Especially if a plurality of lights 156 are included, the lights 156 may be actuated in one or more pattern. Programming may select the pattern based on data from the user input 154, and programming may further select between data to output through the speaker 150 based on data from the user input 154. Moreover, programming may cause the processor 160 to automatically deactivate the speaker 150 and light(s) 156 when the push button 152 determines that the first and second portions 110, 120 have moved to the closed configuration.

In use, one or more diaper 10 may be placed in the pocket 117 and one or more moist wipe may be placed in the compartment 127. The delay(s), data to be output through the speaker 150, and light pattern may be selected using the user input 154. When the first and second portions 110, 120 are moved from the closed configuration to the open configuration, the push button 152 may detect the transition and the processor 160 may automatically actuate the speaker 150 and/or the light(s) 156 after the selected delay. The changing pad 140 may be used as a sanitary changing surface, and the speaker 150 and/or light(s) 156 may distract and occupy a child while its diaper is changed. When the first and second portions 110, 120 are moved to the closed configuration, the push button 152 may detect the transition and the processor 160 may automatically deactivate the speaker 150 and/or the light(s) 156.

It is understood that while certain forms of this invention have been illustrated and described, it is not limited thereto except insofar as such limitations are included in the following claims and allowable functional equivalents thereof.

The invention claimed is:

1. A wallet, comprising:

a semi-rigid first portion having an outer side and an inner side;

a semi-rigid second portion having an outer side and an inner side, said second portion being hingedly coupled to said first portion whereby said second portion is movable relative to said first portion to define open and closed configurations;

means for temporarily maintaining said first and second portions at said closed configuration;

a pocket at said first portion inner side for holding a diaper;

a folding changing pad operatively coupled to at least one of said first portion and said second portion;

a speaker;

means for determining when said first and second portions are at said open configuration; and a processor in data communication with said speaker and said means for determining;

wherein said processor is programmed to automatically actuate said speaker an amount of time after said means for determining determines that said first and second portions are at said open configuration.

2. The wallet of claim 1, wherein:

said first portion has upper and lower ends; and said pocket extends continuously from said first portion lower end to a position closer to said first portion upper end than to said first portion lower end.

3. The wallet of claim 1, further comprising a compartment at said second portion inner side for holding a moist wipe, said compartment being isolated from said pocket.

4. The wallet of claim 3, wherein said folding changing pad separates said compartment from said pocket.

5. The wallet of claim 1, further comprising:

a light in data communication with said processor;

wherein said processor is programmed to automatically actuate said light an amount of time after said means for determining determines that said first and second portions are at said open configuration.

6. The wallet of claim 1, further comprising:

a plurality of lights in data communication with said processor;

wherein said processor is programmed to automatically actuate said plurality of lights in a pattern an amount of time after said means for determining determines that said first and second portions are at said open configuration.

7. The wallet of claim 6, wherein at least one said light outputs a color different from a color of at least one other said light.

8. The wallet of claim 1, further comprising:

a user input in data communication with said processor;

wherein said processor is programmed to select said amount of time based on data from said user input.

9. The wallet of claim 1, further comprising:

a user input in data communication with said processor;

wherein said processor is programmed to select between data to output through said speaker based on data from said user input.

10. The wallet of claim 1, wherein said changing pad includes a magnet for temporarily attaching said changing pad to a ferrous or ferric surface.

11. The wallet of claim 1, wherein said first and second portions enclose an interior space when at said closed configuration.

12. The wallet of claim 1, wherein said processor is programmed to automatically deactivate said speaker when said means for determining determines that said first and second portions have moved to said closed configuration.

13. The wallet of claim 12, further comprising:

a plurality of lights in data communication with said processor;

wherein said processor is programmed to automatically actuate said plurality of lights in a pattern an amount of time after said means for determining determines that said first and second portions are at said open configuration;

wherein said processor is programmed to automatically deactivate said plurality of lights when said means for determining determines that said first and second portions have moved to said closed configuration.

14. The wallet of claim 13, wherein at least one said light outputs a color different from a color of at least one other said light.

15. The wallet of claim 14, further comprising:

a user input in data communication with said processor;

wherein said processor is programmed to select between data to output through said speaker based on data from said user input.

16. The wallet of claim 15, further comprising a compartment at said second portion inner side for holding a moist wipe; and wherein:

said compartment is isolated from said pocket;

said first and second portions enclose an interior space when at said closed configuration; and said folding changing pad separates said compartment from said pocket.

* * * * *